United States Patent [19]

Mehta et al.

[11] Patent Number: 4,999,334

[45] Date of Patent: Mar. 12, 1991

[54] PROTECTIVE COATING FOR THERMAL IMAGES

[75] Inventors: Rajendra Mehta, Centerville; Dale Lakes; William Saluke, both of Dayton, all of Ohio

[73] Assignee: The Standard Register Co., Dayton, Ohio

[21] Appl. No.: 486,944

[22] Filed: Mar. 1, 1990

[51] Int. Cl.[5] ..... B41M 5/18

[52] U.S. Cl. ..... 503/226; 427/152; 503/200

[58] Field of Search ..... 503/226, 200; 427/150–152; 428/211, 537.5

[56] References Cited

U.S. PATENT DOCUMENTS

| | | | |
|---|---|---|---|
| Re. 30,212 | 2/1980 | Carder | 204/159.23 |
| Re. 30,772 | 10/1981 | Friedlander et al. | 525/421 |
| 4,108,840 | 8/1978 | Friedlander | 528/46 |
| 4,113,895 | 9/1978 | Watt et al. | 204/159.11 |
| 4,119,743 | 10/1978 | Lu | 427/44 |
| 4,253,899 | 3/1981 | Takemoto et al. | 150/184 |
| 4,260,703 | 4/1981 | Hodakowski et al. | 525/455 |
| 4,319,811 | 3/1982 | Tu et al. | 428/412 |
| 4,439,291 | 3/1984 | Irving et al. | 526/316 |
| 4,477,327 | 10/1984 | Cassatta et al. | 204/159.15 |
| 4,477,548 | 10/1984 | Harasta et al. | 430/14 |
| 4,552,932 | 11/1985 | Schollenberger | 525/440 |
| 4,591,887 | 5/1986 | Arbree et al. | 503/200 |
| 4,600,630 | 7/1986 | Quinn et al. | 428/203 |
| 4,604,635 | 8/1986 | Wiklof et al. | 503/220 |
| 4,607,084 | 8/1986 | Morris | 525/454 |
| 4,654,233 | 3/1987 | Grant et al. | 427/379 |
| 4,670,295 | 6/1987 | Quinn et al. | 427/10 |
| 4,708,947 | 11/1987 | Maruyama et al. | 503/209 |
| 4,740,495 | 4/1988 | Marinelli et al. | 503/214 |
| 4,781,987 | 11/1988 | Bolgiano et al. | 428/480 |
| 4,886,774 | 12/1989 | Doi | 503/226 |

*Primary Examiner*—Pamela R. Schwartz

*Attorney, Agent, or Firm*—Killworth, Gottman, Hagan & Schaeff

[57] ABSTRACT

A protective coating composition for protection of thermal images on thermal paper is provided. A mixture of oligomers, monomers, and a photocatalyst are blended together, coated onto thermal paper and then cured by ultraviolet radiation. The coating provides protection to images subsequently printed on the paper by providing resistance to solvents, abrasion and fading due to exposure to light.

15 Claims, No Drawings

PROTECTIVE COATING FOR THERMAL IMAGES

BACKGROUND OF THE INVENTION

This invention relates to a protective coating for thermal paper, and more particularly to a protective coating for images formed on the paper and which provides protection from exposure to light, and provides resistance to solvents, soiling and abrasion.

In the field of product labeling, it is common practice to print information such as weight, price, and contents on a product label in bar code form so that it may be read by a scanning machine. The information is generally printed by conventional ink printing apparatus or by thermal printing means. The use of these product labels in every market is increasing. However, especially where thermal paper is used, the printed images on the labels tend to fade after exposure to light and are susceptible to exposure from various elements in the environment such as oils, alcohols, and other solvents during shipment and storage. As a result, it becomes difficult for a scanning machine to read the printed matter on the label accurately.

Many attempts have been made to provide a protective coating for machine-readable labels which will protect the printed image from exposure to solvents. Quinn et al, U.S. Pat. Nos. 4,600,630 and 4,670,295, disclose a protective overcoating for a machine-readable marking. The composition comprises a liquid oligomer and liquid monomer comprised of acrylics which are curable by ultraviolet light. However, this coating is applied only as an overcoat to the marking and is applied only on glass or nonporous materials.

Arbree et al, U.S. Pat. No. 4,591,887, relates to a solvent-resistant thermally printable material for the manufacture of labels comprising a protective layer of a polymeric resin on top of a thermally imprintable color producing layer and an adhesive layer.

Marinelli et al, U.S. Pat. No. 4,740,495 discloses a protective coating for thermal paper labels comprising a thermally reactive layer, and a top coat containing fluorochemical material for solvent protection.

Although Arbree and Marinelli et al disclose protection of thermal images on paper from solvents, neither provides protection to the label from exposure to fluorescent light or sunlight. Further, both Arbree and Marinelli involve multilayer coatings requiring a more complex coating process.

Doi, U.S. Pat. No. 4,886,774 discloses a protective overcoating for thermal paper which protects images against fading from exposure to ultraviolet radiation. However, the Doi composition requires the addition of a separate ultraviolet radiation absorbing composition to provide resistance to fading.

Accordingly, there is still a need in the art for a simple protective coating composition for thermal paper which is effective, easy to apply, and provides protection to thermal images from solvents and abrasion as well as protection from fading by exposure to light.

SUMMARY OF THE INVENTION

The present invention meets that need by providing a cost effective protective coating for thermal paper which protects printed images from fading due to the light exposure and also provides protection from solvents, abrasion, and other elements. In the preferred embodiment of the invention, the protective coating comprises a blend of radiation curable oligomers and monomers, and a photocatalyst.

The preferred oligomers are an aliphatic urethane acrylate and an epoxy diacrylate. The weight ratio of aliphatic urethane acrylate/epoxy diacrylate is preferably about 4.4:1. It is to be understood that while the ratios of oligomers should be kept substantially in this preferred range, the total oligomer content may vary from 15 to 50% by weight of the total coating composition.

The monomers present in the composition are preferably a blend of difunctional and trifunctional acrylates. The preferred monomers are 1,6-hexanediol diacrylate, trimethylolpropane triacrylate and multifunctional polyester acrylate. The weight ratio of trimethylolpropane triacrylate/1,6 hexanediol diacrylate/multifunctional polyester acrylate, respectively, is preferably 5:1:2. Again, it is to be understood that while the ratios of monomers should be kept substantially in this preferred range, the total monomer content may vary from 15 to 40% by weight of the total composition.

The photocatalyst in the coating preferably is one which is activated by ultraviolet light such as benzoin butyl ether, benzoin ketal or other acetophenone derivatives. The photocatalyst preferably comprises about 6–12% by weight of the total coating composition.

The protective coating also optionally includes approximately 5% of a difunctional amine accelerator, 2–4% of an adhesion promoter, and 4–6% of a surface active additive, all percentages by weight.

The process of the present invention comprises the steps of blending the oligomers, monomers, and photocatalyst, and optionally the difunctional amine accelerator, adhesion promoter, and surface active additive, and then coating the mixture onto thermally sensitive printable paper having a thermally imageable coating thereon. The coating is then cured by ultraviolet radiation preferably at a wavelength range of $<330$ nm and most preferably 280–320 nm. Thermal images may then be subsequently printed onto the thermal paper and still receive the protection to light fading, abrasion, and solvents provided by prior overcoating processes. Protection against light fading is provided by the ultraviolet light absorbing capabilities of the preferred oligomer/monomer mixture used in the practice of the present invention.

Thus, the composition and process of the present invention enable one to produce easily and economically a protective coating for thermal images on thermally sensitive printable paper which provides resistance to fading from light exposure, resistance to solvents, soiling and abrasion. As a result, labels or other printed products have imaged areas which are more readily read by automated systems using optical scanning devices because of the increased ability to read the printing on labels or other printed products.

Accordingly, it is an object of the present invention to provide a protective coating for thermal images which is effective, simple to produce, and provides resistance to solvents, abrasion and fading from exposure to light.

DETAILED DESCRIPTION OF THE PREFERRED EMBODIMENTS

In its preferred form, the protective coating of the present invention includes a blend of radiation curable oligomers and monomers and a photocatalyst. The preferred oligomers are aliphatic urethane acrylates, such as those available from Sartomer under the designation SR 9620; and epoxy diacrylates, such as those available from Intrez under the designation Novacure 6700. While the weight ratio of aliphatic urethane acrylate to epoxy acrylate is preferably kept substantially in the preferred range of about 4.4:1 for optimum viscosity, the overall content of oligomers may vary from 15–50% of the total coating composition.

The monomers present in the coating preferably comprise a blend of difunctional and trifunctional acrylates. The preferred monomers are 1,6-hexanediol diacrylate, trimethylolpropane triacrylate, and multifunctional polyester acrylate. The respective weight ratio of the monomers in the coating should preferably be about 5:1:2, but the overall content may vary from 15 to 40 percent of the total coating composition.

The preferred blend of oligomers and monomers are curable by exposure to ultraviolet radiation to form a strong abrasion and solvent resistant coating on thermally sensitive paper. Additionally, the preferred blend of oligomers and monomers exhibit ultraviolet light absorbing properties once coated and polymerized on the paper to provide light fading resistance to images later printed on the paper. It is believed that, particularly, the urethane acrylate oligmer and multifunctional polyester acrylate monomer provide resistance to yellowing and protect from image fading. The urethane acrylate also provides increased flexibility to the coating composition and improves adhesion of the coating to the substrate.

The photocatalyst included in the coating preferably is one activated by ultraviolet light such as benzoin butyl ether, benzoin ketal or other acetophenone derivatives, and preferably comprises about 6–12% by weight of the coating.

The protective coating also optionally includes an amine accelerator, such as a difunctional amine accelerator available under the designation Photomer 4770 from Henkle. The inclusion of the accelerator helps to promote the crosslinking of the oligomer/monomer blend. It is preferably present in an amount of about 5% by weight of the total composition.

An adhesion promoter may also optionally be included in the coating to ensure sufficient adhesion of the coating to the label or paper. A preferred promoter is a styrene-maleic anhydride resin, available from Arco under the designation SMA Resin. It is preferably present in an amount of from 2–4% by weight of the total composition.

A surface active additive may also optionally be included in the coating to ensure that the coating wets the substrate when applied. Suitable surface active additives include DC-193 available from the Dow Chemical Company or FC-430 available from 3M Corporation. It is preferably present in an amount of from about 4–6% by weight of the total composition.

The process of the present invention comprises the steps of blending the oligomers and monomers, and photocatalyst, and optionally the difunctional amine accelerator, adhesion promoter, and surface active additive, and then coating the mixture onto thermal paper. The coating may be applied by any of several conventional processes including roll, reverse roll, blade coating, etc. or by printing methods such as flexography, gravure, etc. The coating is then cured by ultraviolet radiation preferably at a wavelength range of $<330$ nm and most preferably 280–320 nm. The paper or label substrate may later be imaged in a thermal printer as is conventional in the art.

In order that the invention may be more readily understood, reference is made to the following example which is intended to illustrate the invention, but not limit the scope thereof.

EXAMPLE 1

A protective coating composition in accordance with the present invention was prepared by blending 35 parts of an aliphatic urethane acrylate (SR 9620 from Sertomer); 8 parts of an epoxy diacrylate (Novacure 6700 from Intrez); 25 parts of a trimethylolpropane triacrylate (TMPTA from Intrez); 5 parts of a 1,6-hexanediol diacrylate (HDODA from Intrez); 10 parts of a multifunctional polyester acrylate (EBECRYL 1810 from Radcure Specialties); 5 parts of a difunctional amine accelerator (Photomer 4770 from Henkle); 6 parts of a photocatalyst (benzoin butyl ether from Upjohn); 2 parts of an adhesion promoter (SMA resin from Arco); and 4 parts of a surface active additive (DC-193 from Dow), all parts by weight. The mixture was then coated onto a roll of thermal paper by flexographic printing and then cured by ultraviolet radiation at a wavelength of 280–320 nm.

Having described the invention in detail and by reference to preferred embodiments thereof, it will be apparent that modifications and variations are possible without departing from the scope of the invention defined in the appended claims.

What is claimed is:

1. A thermally sensitive printable paper which is resistant to solvents, abrasion, and fading from exposure to light comprising a thermally printable paper substrate having a thermally imageable coating thereon and a protective coating layer over said thermally imageable coating comprising a mixture of an aliphatic urethane acrylate, an epoxy diacrylate, trimethylolpropane triacrylate, 1,6-hexanediol diacrylate, a multifunctional polyester acrylate, and a photocatalyst.

2. The thermally sensitive printable paper of claim 1 wherein said coating layer further comprises a difunctional amine accelerator, styrene-maleic anhydride resin, and a surface active additive.

3. The thermally sensitive printable paper of claim 1 wherein said coating is cured by exposure to ultraviolet radiation.

4. A thermally sensitive printable paper which is resistant to solvents, abrasion, and fading from exposure to light comprising a thermally printable paper substrate having a thermally imageable coating thereon and a protective coating layer over said thermally imageable coating comprising a blend of ultraviolet radiation curable oligomers and monomers and a photocatalyst, wherein said oligomers comprise aliphatic urethane acrylates and epoxy diacrylates and said monomers comprise a blend of difunctional, trifunctional and multifunctional acrylates.

5. The thermally sensitive printable paper of claim 4 wherein said difunctional acrylate is 1,6-hexanediol diacrylate.

6. The thermally sensitive printable paper of claim 4 wherein said trifunctional acrylate is trimethylol propane triacrylate.

7. The thermally sensitive printable paper of claim 4 wherein said multifunctional acrylate is a polyester acrylate.

8. The thermally sensitive printable paper of claim 4 wherein said photocatalyst is selected from the group consisting of benzoin butyl ether, benzoin ketal and acetophenone derivatives.

9. The thermally sensitive printable paper of claim 4 wherein said coating includes an adhesion promoter.

10. The thermally sensitive printable paper of claim 4 wherein said adhesion promoter comprises a styrene-maleic anhydride resin.

11. The thermally sensitive printable paper of claim 4 wherein said coating includes a difunctional amine accelerator.

12. A thermally sensitive printable paper which is resistant to solvents, abrasion, and fading from exposure to light comprising a thermally printable paper substrate having a thermally imageable coating thereon and a protective coating layer over said thermally imageable coating comprising 15–50% by weight of a mixture of aliphatic urethane acrylate and epoxy diacrylate; 15–40% by weight of a mixture of trimethylolpropane triacrylate, 1,6-hexanediol diacrylate and multifunctional polyester acrylate; and 6–12% by weight of a photocatalyst.

13. The thermally sensitive printable paper of claim 12 wherein said aliphatic urethane acrylate and said epoxy diacrylate are present at a weight ratio of 4.4:1, respectively.

14. The thermally sensitive printable paper of claim 12 wherein said trimethylolpropane triacrylate, 1,6-hexanediol diacrylate and multifunctional polyester acrylate are present at a weight ratio of 5:1:2, respectively.

15. A thermally sensitive printable paper which is resistant to solvents, abrasion, and fading from exposure to light comprising a thermally printable paper substrate having a thermally imageable coating thereon and a protective coating layer over said thermally imageable coating comprising 15–50% by weight of a mixture of aliphatic urethane acrylate and epoxy diacrylate; 15–40% by weight of a mixture of trimethylolpropane triacrylate, 1,6 hexanediol diacrylate and multifunctional polyester acrylate; 6–12% by weight of a photocatalyst; 5% by weight of an amine accelerator; 2–4% by weight of a styrene-maleic anhydride resin; and 4–6% by weight of a surface active additive.

* * * * *